US007741945B2

(12) United States Patent
Godbey

(10) Patent No.: US 7,741,945 B2
(45) Date of Patent: Jun. 22, 2010

(54) DRY-TYPE TRANSFORMER WITH IMPROVED TERMINAL CONSTRUCTION AND MOUNTING SYSTEM THEREFOR

(75) Inventor: Rodney Godbey, Wilson, NC (US)

(73) Assignee: ABB Technology AG, Zurich (CH)

( * ) Notice: Subject to any disclaimer, the term of this patent is extended or adjusted under 35 U.S.C. 154(b) by 17 days.

(21) Appl. No.: 12/357,707

(22) Filed: Jan. 22, 2009

(65) Prior Publication Data

US 2009/0189726 A1 Jul. 30, 2009

Related U.S. Application Data

(60) Provisional application No. 61/023,150, filed on Jan. 24, 2008.

(51) Int. Cl.
*H01F 27/29* (2006.01)
*H01F 27/28* (2006.01)
*H01R 4/48* (2006.01)

(52) U.S. Cl. ..... 336/229; 336/192; 439/859

(58) Field of Classification Search ..... 439/859–860
See application file for complete search history.

(56) References Cited

U.S. PATENT DOCUMENTS

| | | | | |
|---|---|---|---|---|
| 1,946,713 | A * | 2/1934 | Rowley | 439/868 |
| 5,295,860 | A * | 3/1994 | Jozefczyk et al. | 439/503 |
| 6,160,468 | A * | 12/2000 | Himei | 336/198 |
| 7,224,253 | B2 * | 5/2007 | Chung | 335/299 |
| 2004/0021540 | A1 * | 2/2004 | Cattaneo | 336/174 |

FOREIGN PATENT DOCUMENTS

JP 409213528 A * 8/1997

* cited by examiner

*Primary Examiner*—Anh T Mai
(74) *Attorney, Agent, or Firm*—Paul R. Katterle

(57) ABSTRACT

The invention is directed to a transformer having a ferromagnetic core with a coil disposed around the core. An insulation layer is disposed over the core and the coil and terminals are connected to the coil. Each of the terminals is formed from cast metal and has a base and a connector. The base is at least partially disposed under the insulation layer. A connector is joined to the base at about a right angle and is located toward the middle of the base.

20 Claims, 6 Drawing Sheets

DRY-TYPE TRANSFORMER WITH IMPROVED TERMINAL CONSTRUCTION AND MOUNTING SYSTEM THEREFOR

CROSS-REFERENCE TO RELATED APPLICATION

This application claims the benefit of U.S. provisional patent application No. 61/023,150 filed on Jan. 24, 2008, which is hereby incorporated by reference in its entirety.

BACKGROUND OF THE INVENTION

This invention relates to transformers and more particularly to terminals for dry-type transformers.

A transformer with a dry-type construction includes at least one coil mounted to a core so as to form a core/coil assembly. The core is ferromagnetic and is often comprised of a stack of metal plates or laminations composed of grain-oriented silicon steel. The core/coil assembly is enclosed by protective material to separate the core/coil assembly from the surrounding environs. If the transformer is constructed for mounting inside a building or other protective structure, the protective material may be adapted to primarily provide electrical insulation, whereas if the transformer is constructed for exterior mounting, the protective material may be adapted to provide both electrical insulation and environmental protection.

Referring now to FIGS. 1*a* and 1*b*, there is shown a prior art terminal 10 that is conventionally used in dry-type transformers. The terminal 10 includes a tongue-shaped connector 12 joined by a narrow neck (not shown) to a crimp 14 having a split cylindrical shape. In FIG. 1*a*, the terminal 10 is shown as it is received from a manufacturer. In order to be used in a transformer, the connector 12 must be bent at the neck so as to be disposed at a ninety degree (right) angle to the crimp 14, as shown in FIG. 1*b*. The bending of the neck creates stress that can lead to breakage.

The present invention is directed to a terminal and mounting system therefor for use in a dry-type transformer, wherein the terminal is less susceptible to breakage.

SUMMARY OF THE INVENTION

In accordance with the present invention, a transformer is provided having a ferromagnetic core and a coil disposed around the core. A terminal is connected to the coil. The terminal is formed from cast metal and includes a base and a connector disposed at about a right angle to the base. The connector has opposing first and second sides. The connector is joined to the base such that a first portion of the base extends from the first side of the connector and a second portion of the base extends from the second side of the connector. A mount is joined to the first portion of the base and is connected to the coil. The mount has a bore that extends along a longitudinal axis of the mount. The axis is disposed at about a right angle to the connector.

Also provided in accordance with the present invention is a transformer having a ferromagnetic core and a coil disposed around the core. An insulation layer is disposed over the core and the coil. Terminals are connected to the coil. Each of the terminals is formed from a rigid, non-bendable material and includes a base at least partially disposed under the insulation layer. A connector is joined to the base at about a right angle and is located toward the middle of the base.

BRIEF DESCRIPTION OF THE DRAWINGS

The features, aspects, and advantages of the present invention will become better understood with regard to the following description, appended claims, and accompanying drawings where:

DETAILED DESCRIPTION OF ILLUSTRATIVE EMBODIMENTS

Figure 1B:
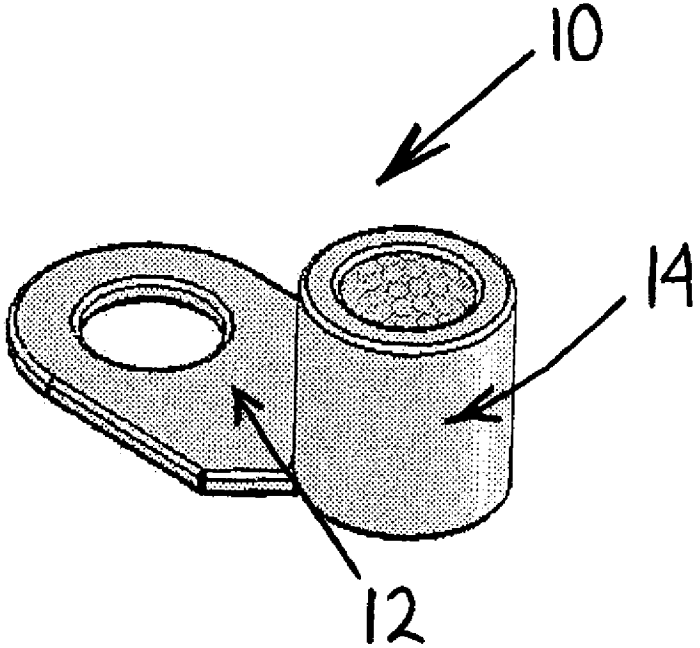
Prior Art Fig. 1B
FIG. 1*b* shows a perspective view of a prior art terminal after it has been modified for use in a transformer.
Figure 1A:
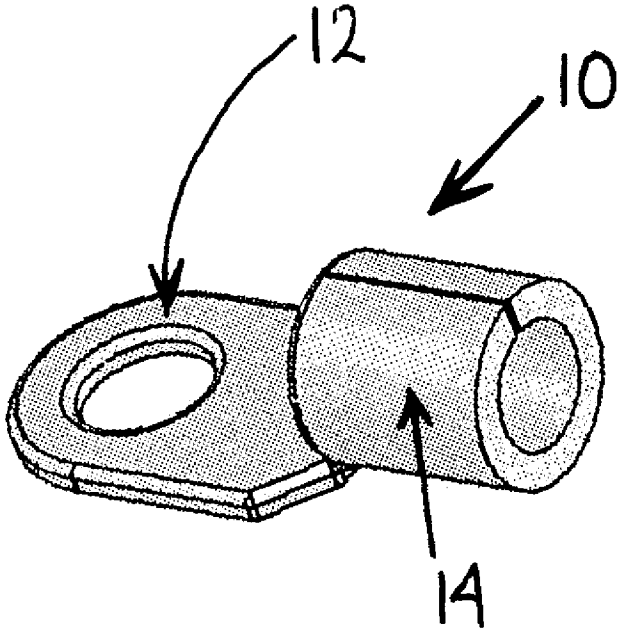
Prior Art Fig. 1A
FIG. 1*a* shows a perspective view of a prior art terminal before it is modified for use in a transformer.

It should be noted that in the detailed description that follows, identical components have the same reference numerals, regardless of whether they are shown in different embodiments of the present invention. It should also be noted that in order to clearly and concisely disclose the present invention, the drawings may not necessarily be to scale and certain features of the invention may be shown in somewhat schematic form.

As used herein, the abbreviation "CT" shall mean "current transformer".

Figure 2:
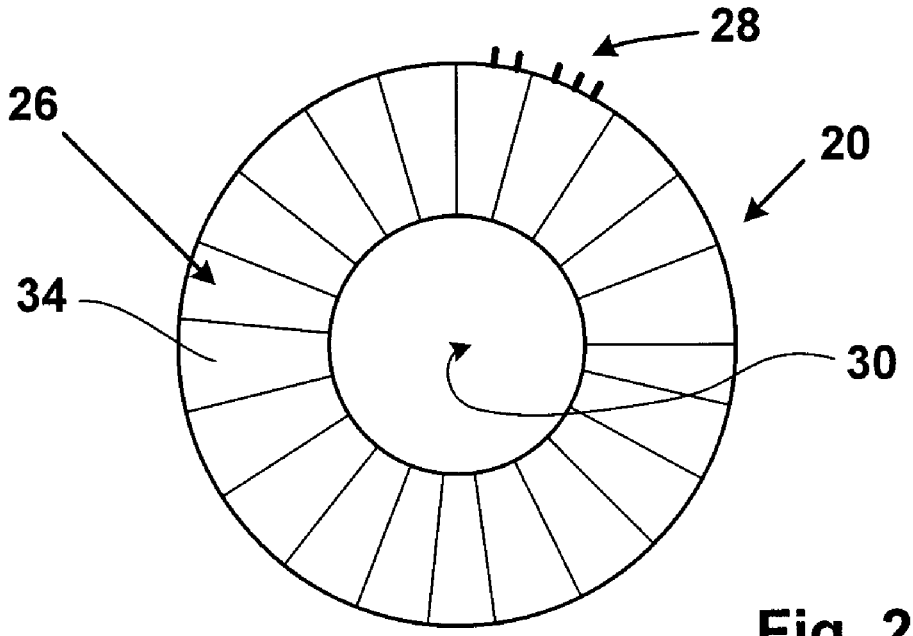
FIG. 2 shows a front view of a transformer.
Figure 3:
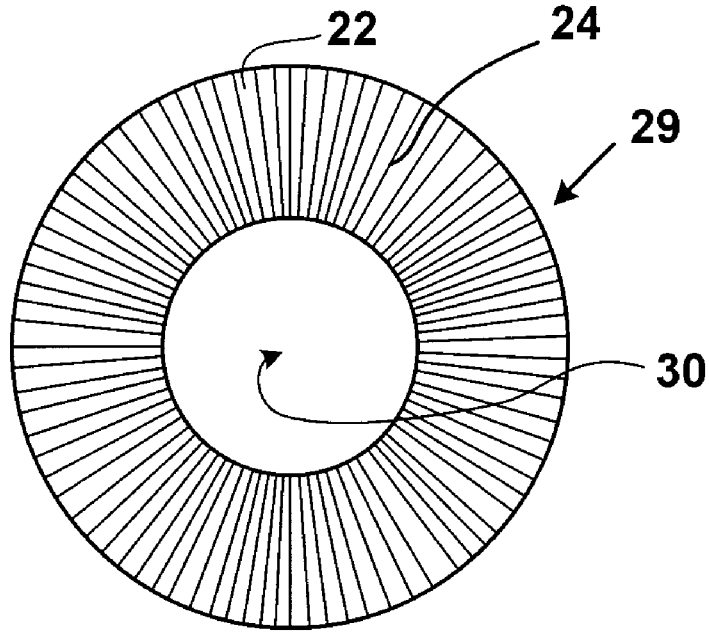
FIG. 3 shows a front view of a core/coil assembly of the transformer.

Referring now to FIG. 2, there is shown a schematic view of a transformer 20 constructed in accordance with the present invention. The transformer 20 is a current instrument transformer that is adapted for interior use. The transformer 20 may step down current in a range of 10 to 2,500 amps to a current in a range of 1 to 5 amps. With reference now also to FIG. 3, the transformer 20 generally comprises a core 22, a secondary or low voltage winding 24, insulation 26 and terminal assemblies 28. For ease of description, the combination of the core 22 and the low voltage winding 24 are hereinafter referred to as the core/coil assembly 29.

The core 22 has a torroidal shape with a central opening 30 and is composed of a ferromagnetic material, such as iron or steel. The core 22 may be comprised of a strip of steel (such as grain-oriented silicon steel), which is wound on a mandrel into a coil. The low voltage winding 24 comprises a length of wire, such as copper wire, wrapped around the core 22 to form a plurality of turns that are disposed around the circumference of the core 22. When the transformer 20 is in use, a conductor, such as a bus bar, extends through the opening 30 and constitutes one turn of a primary or high voltage winding. The low voltage winding 24 may have a single CT ratio or multiple CT ratios. In this regard, it should be noted that a CT ratio is the ratio of the rated primary current (in the primary coil) to the rated secondary current (in the secondary coil). In the embodiment shown in the drawings, the low voltage winding 24 has a multi-ratio construction with five taps 25, which are connected to the terminal assemblies 28, respectively. Different combinations of the taps provide a range of CT ratios, such as from 50:5 to 600:5 or from 500:5 to 4000:5. The taps 25 are connected at different points along the travel of the low voltage winding 24. For example, two of the taps 25 may be connected at opposing ends of the low voltage winding 24 and the other three taps 25 may be connected to low voltage winding 24 in between the two end taps 25 in a spaced apart manner. Thus, the number of turns of the low voltage winding 24 between different pairs of taps 25 are different, thereby creating different CT ratios.

The insulation 26 is disposed over the core/coil assembly 29 and is operable to electrically insulate the core/coil assembly 29 from the surrounding environs. The insulation 26 may be comprised of a single layer of insulating material, or multiple layers of insulating material. In the embodiment shown in FIG. 7, the insulation 26 comprises a first layer 34 and a second layer 36. The first layer 34 may be comprised of a web of cellulosic material, such as pressboard or presspaper, which are typically formed from wood pulp and/or cotton fibers. The first layer 34 may be comprised of four pieces of pressboard: an outer strip 34*a* disposed over the outer circumference of the core/coil assembly 29, with its ends secured together by tape or other means; an inner strip disposed over the inner circumference of the core/coil assembly 29, with its ends secured together by tape or other means; and front and rear annular pieces disposed over the front and rear sides of the core/coil assembly 29, respectively, and secured together by bands of tape or other means. The second layer 36 may be formed from cotton tape wound around the first layer 34 and impregnated with a varnish, such as a polyester varnish or an epoxy varnish.

Figure 4:
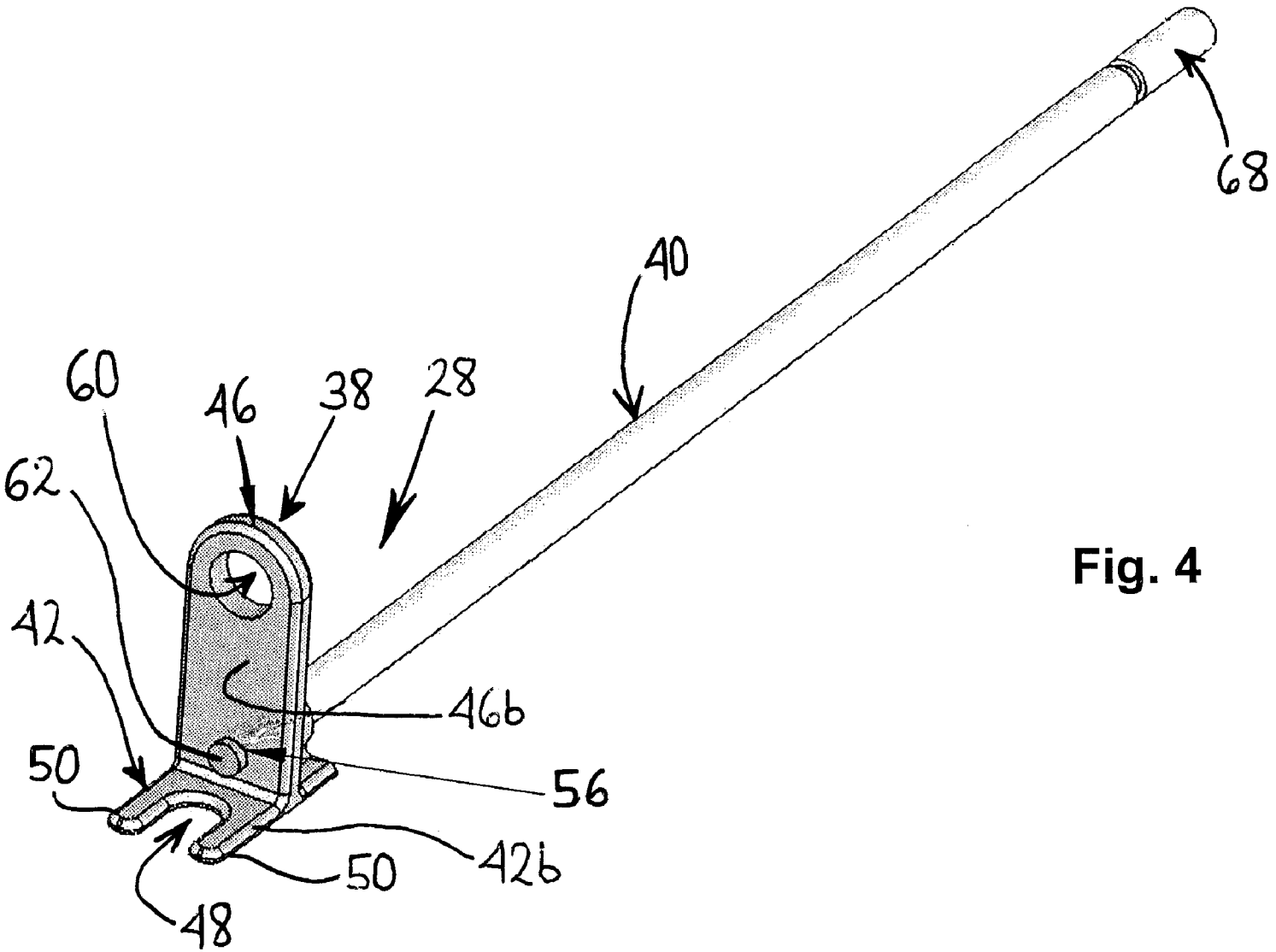
FIG. 4 shows a perspective view of a terminal assembly embodied in accordance with the present invention.
Figure 5:
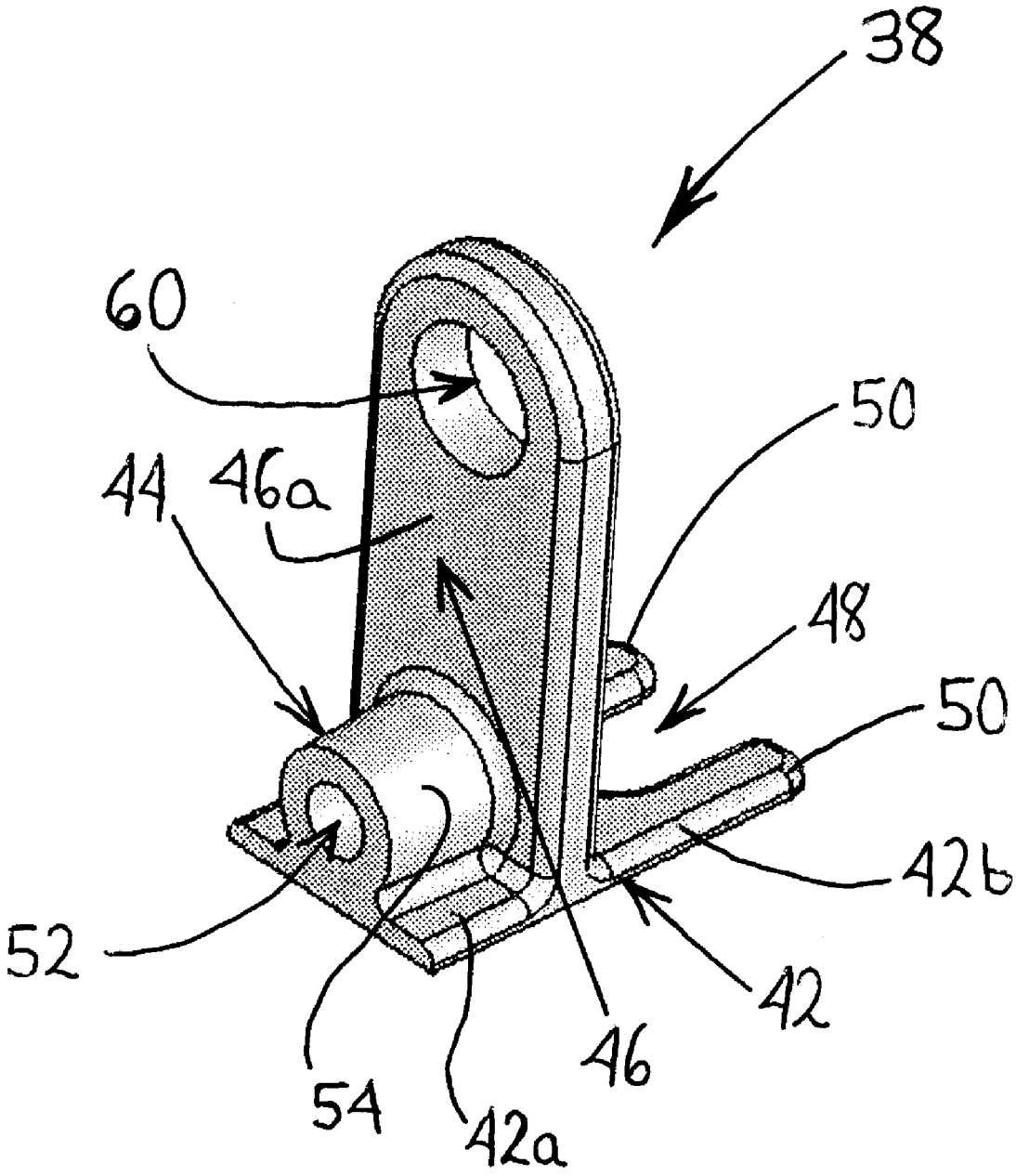
FIG. 5 shows a perspective view of a terminal of the terminal assembly.
Figure 6:
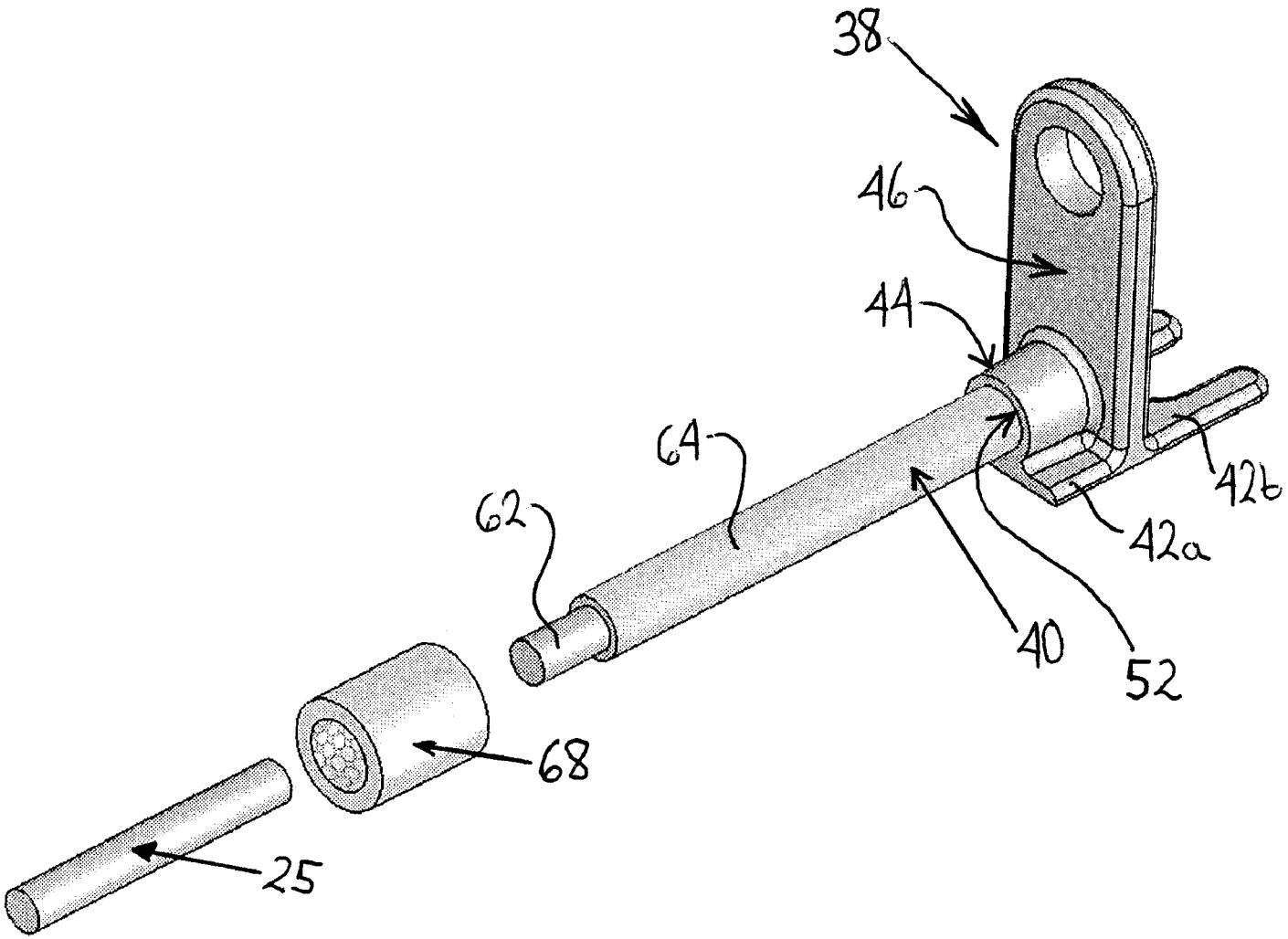
FIG. 6 shows a perspective view of the terminal assembly being connected to a tap of the core/coil assembly of the transformer.

Referring now to FIGS. 4-6, each terminal assembly 28 includes a terminal 38 and a wire lead or pig tail 40.

The terminal 38 is formed from cast metal, i.e., molten metal is introduced into a mold and is allowed to solidify within the mold to form the terminal 38. In one embodiment, the terminal 38 may be formed in a centrifugal casting process. The metal may be copper, or a copper alloy comprising copper and a minor amount of silver. The terminal 38 includes a relatively flat base 42, a cylindrical mount 44 and a tongue-shaped connector 46.

The base 42 has first and second ends and planar top and bottom surfaces. A notch 48 extends inwardly from the second end to form a pair of feet 50. The mount 44 has an axial bore 52 extending therethrough and a cylindrical side wall 54 that is continuous, i.e., is not split like the crimp 14 in the prior art terminal 10. The side wall 54 is integrally joined to the base 42 such that a first end of the mount 44 is aligned with the first end of the base 42. The connector 46 has opposing first and second sides 46*a*, 46*b*, a bottom end integrally joined to the base 42 and a free top end with an arcuate upper edge. A circular opening 60 extends through the connector 46 and is located toward the upper edge of the connector 46. The connector 46 is integrally joined to a second end of the mount 44 and has an opening 56 aligned with the bore 52.

As shown in the drawings and described above, the cylindrical axis of the mount 44 (which extends through the bore 52) is disposed parallel to the base 42. The connector 46 is disposed at a substantially right angle to the base 42 and, thus, the cylindrical axis of the mount 44. The connector 46 is located toward the middle of the base 42. Thus, a first portion 42*a* of the base 42 extends away from the first side 46*a* of the connector 46 and a second portion 42*b* of the base 42 extends away from a second side 46*b* of the connector 46. The mount 44 is joined to the first portion 42*a*, while the feet 50 are located in the second portion 42*b*.

The connector 46 is fixed relative to the mount 44. More specifically, the connector 46 cannot be moved relative to the mount 44 by normal hand strength. Since the terminal 38 is composed of cast metal, the terminal 38 is rigid and will not significantly bend to permit the connector 46 to move relative to the mount 44. Instead, the terminal 38 will crack and then break, but only when a large amount of force has been applied to the terminal 38. It has been found that when the base 42 is firmly held and a force is evenly applied to the face of the connector 46 in a direction parallel to the length of the base 42, the terminal will not break until the magnitude of the force is greater than 50 lbs, more particularly, greater than 60 lbs, still more particularly about 70 lbs.

The pigtail 40 comprises a length of wire 62 with an insulation jacket 64 disposed around a portion thereof. The wire 62 is composed of a metal, such as copper. The jacket 64 may be composed of a polymeric material, such as polyethylene or polyvinyl chloride. The jacket 64 is not as long as the wire 62 and is positioned along the wire 62 such that the wire 62 is exposed at opposing end portions of the pigtail 40.

In each terminal assembly 28, a first end portion of the wire 62 of the pigtail 40 extends through the bore 52 of the mount 44 and the aligned opening 56 in the connector 46. The first end portion of the wire 62 is secured to the connector 46 by soldering. A second end portion of the wire 62 of the pigtail 40 is secured to an end of one of the taps 25 by abutting the second end portion of the wire 62 against the end of the tap 25 inside a cylindrical butt splice 68 and then crimping the butt splice 68 using a crimping tool. The butt splice 68 has a split cylindrical side wall to facilitate deformation when it is crimped.

Figure 7:
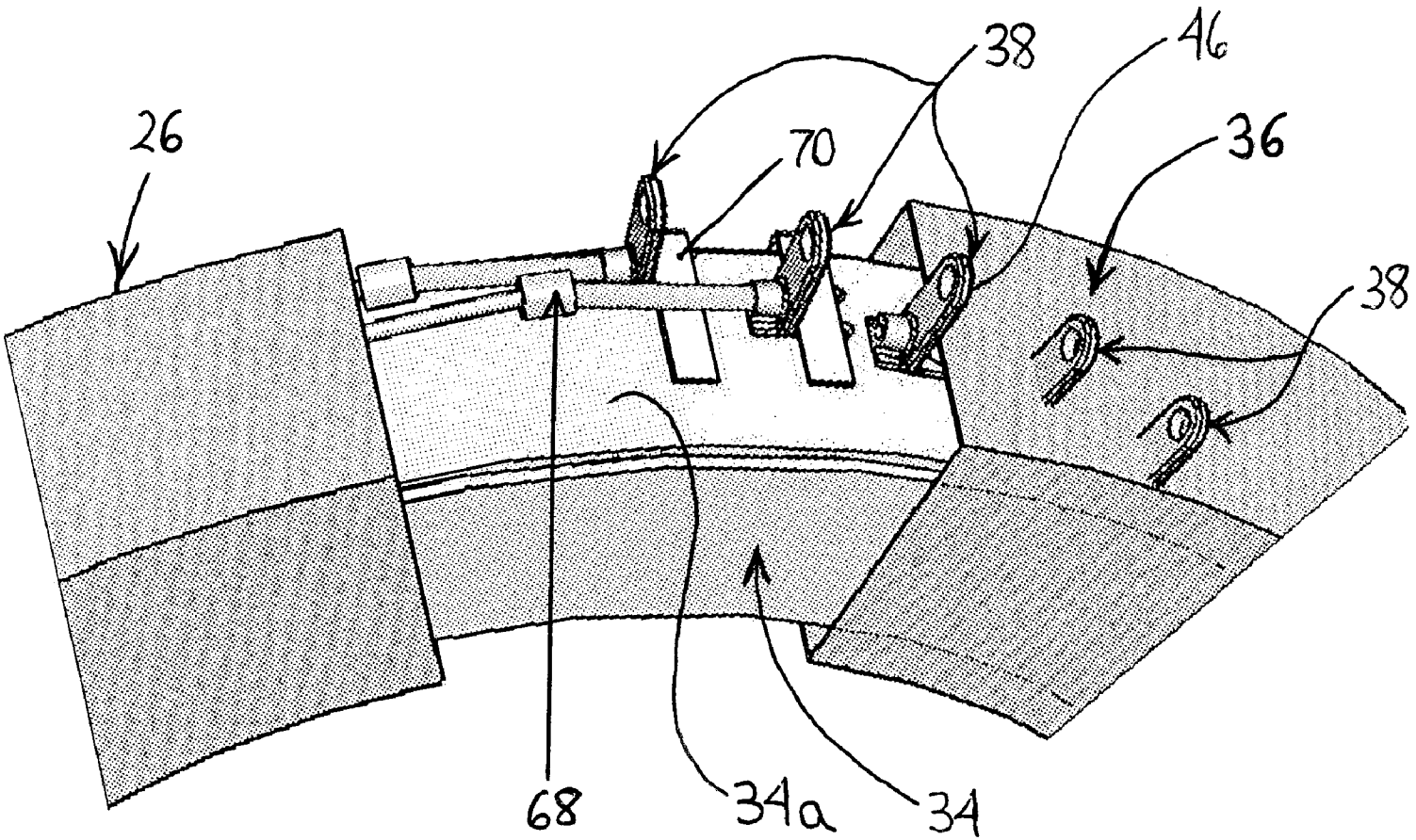
FIG. 7 shows terminal assemblies being mounted to the transformer.

Referring now to FIG. 7, the terminal assemblies 28 are secured to the taps 25 before the second layer 36 of the insulation 26 is wound around or otherwise applied over the first layer 34. The terminal assemblies 28 are arranged in a staggered fashion on the outer strip 34*a*. Each terminal assembly 28 is secured to the outer strip 34*a* by a piece of adhesive tape that is disposed over the second portion 42*b* of the base 42. After the terminal assemblies 28 are secured to the outer strip 34*a*, the second layer 36 is wound around or otherwise applied over the first layer 34 such that the connectors 46 of the terminal assemblies 28 extend through gaps between turns of the second layer 36, or through openings formed in the second layer 36. In this manner, in each terminal assembly 28, the second layer 36 covers the base 42, thereby trapping the base 42 between the first layer 34 and the second layer 36. With the terminal assemblies 28 so secured, the connectors 46 extend radially outward from the core/coil assembly 29.

The transformer 20 may be mounted on a stab or bus bar of a circuit breaker, on a power cable, or on a bushing of a larger transformer. When the transformer 20 is so mounted, the stab, bus bar, cable or bushing extends through the opening 30 in the core 22 and constitutes one turn of a primary or high voltage winding. Although, the transformer 20 is adapted for interior use, the present invention is not limited to use in an interior transformer and may be used in a transformer adapted for exterior use. For example, the transformer 20 may be encapsulated in a resin case so as to be usable outside. In such an application, the connectors 46 of the terminal assemblies 28 may be extended in length to extend through the resin case and be readily accessible from outside the case.

It is to be understood that the description of the foregoing exemplary embodiment(s) is (are) intended to be only illustrative, rather than exhaustive, of the present invention. Those of ordinary skill will be able to make certain additions, deletions, and/or modifications to the embodiment(s) of the disclosed subject matter without departing from the spirit of the invention or its scope, as defined by the appended claims.

What is claimed is:

1. A transformer comprising:

a ferromagnetic core;

a coil disposed around the core;

a terminal connected to the coil, the coil being formed from cast metal and comprising:

a base;

a connector disposed at about a right angle to the base and having opposing first and second sides, the connector being joined to the base such that a first portion of the base extends from the first side of the connector and a second portion of the base extends from the second side of the connector; and a mount joined to the first portion of the base and being connected to the coil, the mount having a bore that extends along a longitudinal axis of the mount, the axis being disposed at about right angle to the connector.

2. The transformer of claim 1, wherein the mount has a continuous cylindrical side wall joined to the base.

3. The transformer of claim 1, further comprising a pigtail having a first end portion extending through the bore in the mount and a second end portion connected to the coil.

4. The transformer of claim 3, wherein the first end portion of the pigtail also extend through a hole in the connector aligned with the bore in the mount, and wherein the first end portion of the pigtail is secured to the connector by solder.

5. The transformer of claim 1, wherein the terminal is comprised of copper.

6. The transformer of claim 1, wherein the core is torroidal.

7. The transformer of claim 6, further comprising insulation disposed over the core and the coil.

8. The transformer of claim 7, wherein the insulation comprises first and second layers.

9. The transformer of claim 8, wherein the base of the terminal is disposed between the first and second layers.

10. The transformer of claim 9, wherein the first portion of the base is secured to the first layer.

11. The transformer of claim 10, wherein the first layer is comprised of pressboard.

12. The transformer of claim 11, wherein the first portion of the base is secured to the first layer of the insulation by pieces of adhesive tape.

13. The transformer of claim 6, wherein the transformer is a current transformer, the terminal is a first terminal, and the transformer further comprises a second terminal having substantially the same construction as the first terminal.

14. The transformer of claim 13, wherein the winding is a secondary winding and has multiple ratios.

15. A transformer comprising:

a ferromagnetic core;

a coil disposed around the core;

an insulation layer disposed over the core and the coil;

terminals connected to the coil, each of the terminals being formed from a rigid, non-bendable material and comprising:

a base at least partially disposed under the insulation layer; and a connector joined to the base at about a right angle and located toward the middle of the base.

16. The transformer of claim 15, wherein the insulation layer is a first insulation layer and the transformer further comprises a second insulation layer disposed under the first insulation layer.

17. The transformer of claim 16, wherein the bases of the terminals are disposed between the first and second layers.

18. The transformer of claim 17, wherein the first layer is comprised of pressboard and the first portions of the bases are secured to the first layer by pieces of adhesive tape.

19. The transformer of claim 15, wherein the transformer is a current transformer and the core is torroidal.

20. The transformer of claim 15, wherein the rigid material comprises cast metal.

* * * * *